US005484227A

United States Patent [19]

Ikeda et al.

[11] Patent Number: 5,484,227

[45] Date of Patent: Jan. 16, 1996

[54] CONTROL DEVICE FOR ASPHALT FINISHER

[75] Inventors: Hachiro Ikeda; Noriaki Miyamoto, both of Tagajo; Ryoei Umeda, Tokyo; Hidenori Yasu, Kadoma; Mitsuo Fukukawa; Yukiei Masuyama, both of Tokyo; Shoji Kinoshita, Kounosu; Yukio Takagi, Tokyo; Tomohiro Gocho, Omiya; Fumio Goto, Gunma; Akio Ishii, Gunma; Tetsuo Ogawa, Gunma; Yoshun Hasegawa, Yokohama; Keitaro Hironaka, Yokohama; Yasuhiro Ogoshi, Yokohama, all of Japan

[73] Assignees: Niigata Engineering Co., Ltd.; The Nippon Road Co., Ltd., both of Tokyo, Japan

[21] Appl. No.: 223,644

[22] Filed: Apr. 6, 1994

[30] Foreign Application Priority Data

Apr. 9, 1993 [JP] Japan ..... 5-083658
Apr. 9, 1993 [JP] Japan ..... 5-083659

[51] Int. Cl.[6] ..... E01C 19/48

[52] U.S. Cl. ..... 404/84.1; 404/118

[58] Field of Search ..... 404/84.05, 84.1, 404/84.2, 118

[56] References Cited

U.S. PATENT DOCUMENTS

| | | | |
|---|---|---|---|
| 3,298,352 | 1/1967 | Vrablik . | |
| 3,967,912 | 7/1976 | Parker | 404/84.05 |
| 4,012,160 | 3/1977 | Parker | 404/84.05 |
| 4,780,022 | 10/1988 | Ohiba et al. | 404/84.1 X |
| 4,930,935 | 6/1990 | Quenzi et al. | 404/75 |
| 4,948,292 | 8/1990 | Haven et al. | 404/84.2 |
| 5,356,238 | 10/1994 | Musil et al. | 404/84.1 |
| 5,362,177 | 11/1994 | Bowhall et al. | 404/84.1 |

FOREIGN PATENT DOCUMENTS

| | | |
|---|---|---|
| 0382647 | 8/1990 | European Pat. Off. . |
| 4204481 | 10/1992 | Germany . |
| 334781 | 4/1986 | Japan . |
| 432883 | 7/1986 | Japan . |

*Primary Examiner*—William P. Neuder
*Attorney, Agent, or Firm*—Kane, Dalsimer, Sullivan, Kurucz, Levy, Eisele and Richard

[57] ABSTRACT

Efficient paving operation requires that the levelling operation of asphalt be carried out accurately along a reference line which follows a given direction along a roadside. A simple and effective automatic control device for controlling the steering direction in conjunction with adjustments of the screed for an asphalt finisher (shortened to finisher) is presented. The control device automatically regulates the extension or retraction of the screeds on both sides of the finisher in reference to a visual display of the reference line following some objects along the roadside. The visual detection system of control is simple and economical and provides an accurate control over the direction of paving.

17 Claims, 7 Drawing Sheets

CONTROL DEVICE FOR ASPHALT FINISHER

BACKGROUND OF THE INVENTION

1. Field of the Invention

The present invention relates in general to an asphalt finisher for road paving, and related in particular to an automatic control system for use with the asphalt finisher.

2. Technical Background

Automation is a key factor in efficient and economical road construction, and much effort is expended in developing automated control systems for various aspects of asphalt finishers. For example, the inventors of the present invention have previously disclosed an automatic directional control device for use with an asphalt finisher (Japanese Patent Application, Second Publication, H4-32883), and a device for controlling the operation of screeds of an asphalt finisher (Japanese Utility Model Application No. H3-34781).

The automatic directional control device (H4-32883) was designed to detect the travel direction of an asphalt finisher (referred to as the finisher herein below) in accordance with the signals emitted from three light sensors which are arranged laterally on the front section of a finisher body to detect a reference line disposed on a roadside.

The screed is a device for levelling the asphalt within a defined region of the road so as to align appropriately to the edges of the road, and is disposed on the side sections of the finisher. The screeds are required to be extended or contracted depending on the position of the finisher with respect to the reference line. In a conventional finisher, this operation is performed manually by a finisher operator who controls fluid pressure in a plurality of hydraulic cylinders so as to move the cylinders to left or right in accordance with his visual confirmation of the reference line and instructions from a screed manager. The screed manager is responsible for the quality of the paved road, and he may be required to travel from side to side to check the direction of the travel or he may choose to assign the task of monitoring the road width to a couple of sidemen to watch the edges of the laid down asphalt, so that he may concentrate on the duty of maintaining the paving quality. Such working conditions are generally not satisfactory and ultimately resulted in manual adjustments of the road width, and other such labor-intensive corrective measures.

An improvement in the conventional approach was achieved in the above-noted invention (H3-34781), by providing a detector, such as a CCD camera to detect the reference line, so as to controller the expansion or retraction of the screed by a screed control device.

This screed controller device described above presented the following problem, however. When the detector is disposed at the rear section of the finisher, and if the road width is becoming narrow, the front edge of the screed projects outward of the road and results in laying down of the asphalt mixture beyond the reference line. This type of design is also not applicable when the reference line is based on roadside objects which project out of the ground surface, because the screed tended to collide with it.

For an efficient operation of the finisher, it is ideal to provide an integrated automatic control of the finisher which is capable of accommodating changing widths of the road. However, in developing a control system for these devices described above, it was found that two sets of sensors, one for directional control and one for screed control, be placed at different location of the finisher. This presented a problem that the system became complex and resulted in a high cost for the control system.

SUMMARY OF THE PRESENT INVENTION

The purpose of the present invention is to present a simple and cost effective control system for controlling the paving operation with the use of an asphalt finisher having a plurality of screeds for levelling the asphalt, in conjunction with an automatic control of steering for the asphalt finisher.

An aspect of the present invention is a control methodology of screed extension and contraction based on the data from a detection device to compute the deviation of the current position of the vehicle in the moving direction with respect to a reference line.

The above purpose is achieved with a device for controlling the extension or retraction of a plurality of screeds in an asphalt finisher comprising: a screed control device disposed on a vehicle member for extending or retracting the plurality of screeds to the left or to the right of the asphalt finisher so as to perform a levelling operation: a detection device disposed on a side region of a screed for determining the position of a reference line generated in relation to a roadside line: a master controller for controlling the operation of the screed controller in accordance with the output data from the detection device.

A screed can be provided with the above described screed controller comprising a forward and a rearward detection devices on the side of the screed, and determines whether the road is becoming wider, narrower or remain at a constant width in terms of forward and rearward detection devices. Therefore, in all the cases of road width conditions, the screed controller of the present invention is able to prevent the end section of the screed to extend beyond the reference line.

The screed controller of the above configuration is incorporated in an automatic control system including a device for steering the asphalt finisher of the present invention, so as to perform an efficient paving operation using a relatively inexpensive control system. The automatic control device comprises: a steering device for controlling the direction of travel of the asphalt finisher having a plurality of screeds for performing a levelling operation; a screed controller for controlling the extension or retraction of the plurality of screeds to the left or to the right of the asphalt finisher; a detection device disposed on a side region of a screed for determining the position of a reference line generated in relation to a roadside line; a master controller for controlling the operation of the screed controller and a steering device for directing the movement of the asphalt finisher in accordance with the output data from the detection device.

The screed can be provided with the above described screed controller comprising a forward and a rearward detection devices on the side of the screed for generating an image of the reference line along the roadside, and the resulting image is utilized as a control guide for determining the amount of deviation of the asphalt finisher with respect to the reference line. The detection devices are interconnected electrically with the screed controller to provide automatic extension or retraction adjustments in the position of the screed with respect to the reference line.

The automatic control device of the present invention for steering the direction of the asphalt finisher operates in conjunction with the screed controller as described above to provide an efficient and cost effective paving operation.

PREFERRED EMBODIMENTS

Figure 1:
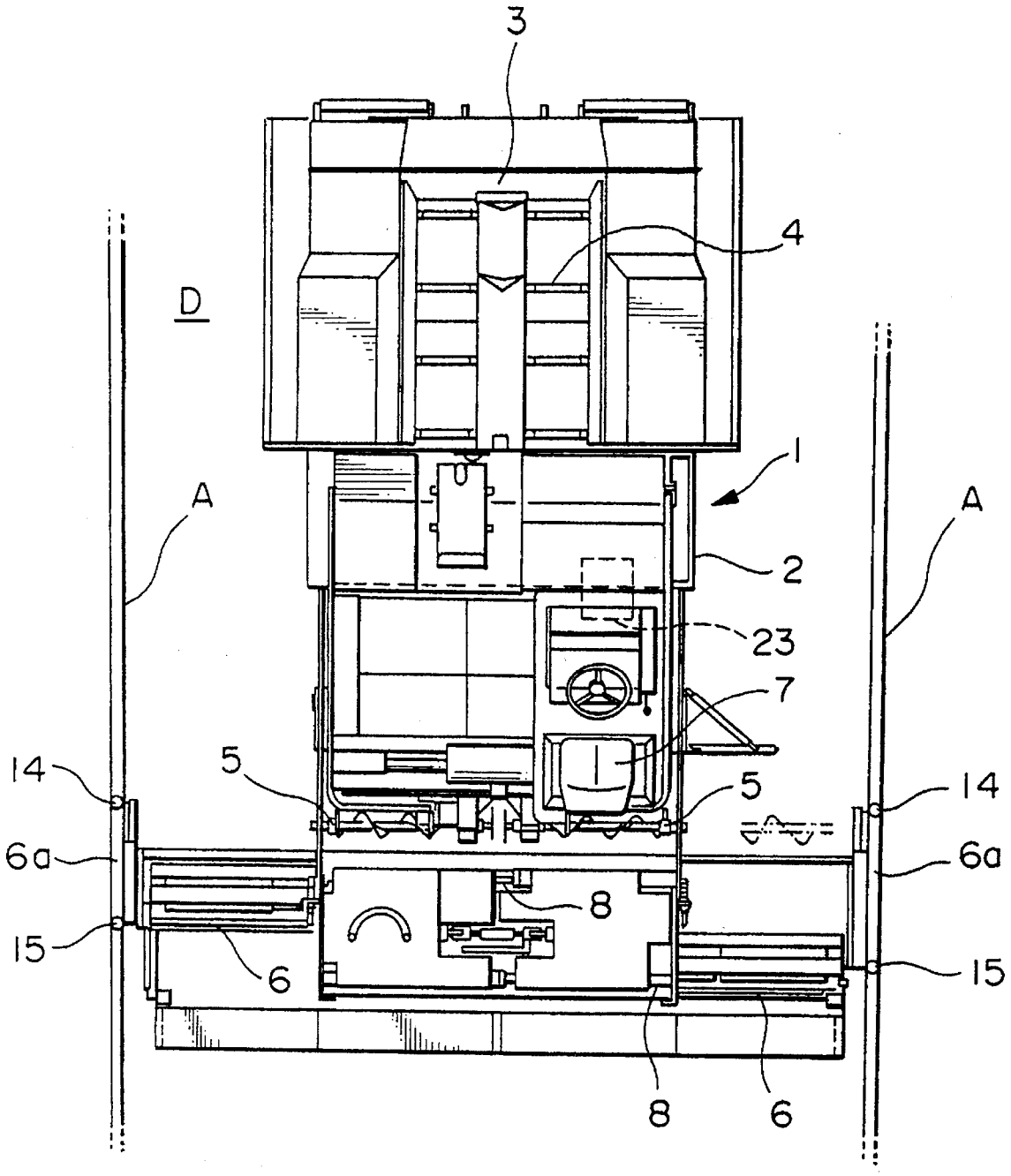
FIG. 1 is a schematic plan view showing an arrangement of the key members of an asphalt finisher.

Preferred embodiments of the present invention will be explained in the following with reference to the drawings presented in FIGS. 1 to 8.

In these drawings, the reference numeral 1 refers to an asphalt finisher (hereinbelow shortened as finisher). The finisher 1 is provided with a vehicle member 2 which has a hopper 3 at its front section, and it is provided with a screw member 5 at its rear section, which serves to spread the asphalt mixture, forwarded from the hopper 3 by a feeder 4, to the left and right directions of the finisher 1. The finisher 1 is also provided with a left-right pair of screeds 6 for levelling the asphalt mixture spread by the screw member 5. The vehicle member 2 is provided with a pair of front wheels **2*a* (refer to FIG. 2) and a pair of rear wheels 2*b*, and changes its travel direction by having the front wheels 2*a* rotated to left or right about a king pins 2*c* by means of the steering device 10 (refer to FIG. 8). An operator sits in a driver seat 7 provided in the vehicle member 2** to take command of the finisher operation.

The pair of screed 6 is disposed with one screed in a slightly leading position ahead of the other, and can be controlled independently of the other by a screed controller 8 to extend the screed 6 to left or right. There is an electromagnetic switching valve (referred to as EM-switching valve) 9, shown in FIG. 8, in each of the hydraulic control circuit of the screed controller device 8 for changing the direction of motion of the screed control device 8. Each of the screed 6 is provided with an end plate **6*a*. The vehicle member 2 is driven by a hydraulic motor 12 whose speed is varied by a proportional valve 11 (refer to FIG. 8), and the speed is monitored by a moving speed detector 13. Such construction of the finisher 1** is well known.

Figure 7:
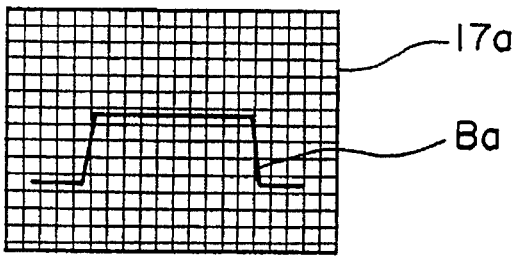
FIG. 7 is an example of the display of the image generated.

On the side surface of each of the end plates **6*a* are disposed a forward detection device 14 disposed separately from a rearward detection device 15 along a line parallel to the longitudinal center line of the vehicle member 2. The detection devices 14, 15 are composed of a semiconductor laser emitter 16 (refer to FIG. 6) and a CCD camera 17, respectively. The laser emitter 16 emits a slit-shaped laser beam which irradiates a reference line (plane) A, consisting of fixed objects along the roadside of the paving road, such as edging stones, and the camera 17 records an illuminated line B generated by irradiating the fixed objects along the reference line A, and displays the image B on the screen of a display device 17*a* (refer to FIG. 7). An example is shown in FIG. 7, which shows a case of the screed 6** being in the correct position with respect to the reference line A, and in this case, the image B is symmetrical about a vertical line, and is disposed in the horizontal center of the screen.

Figure 8:
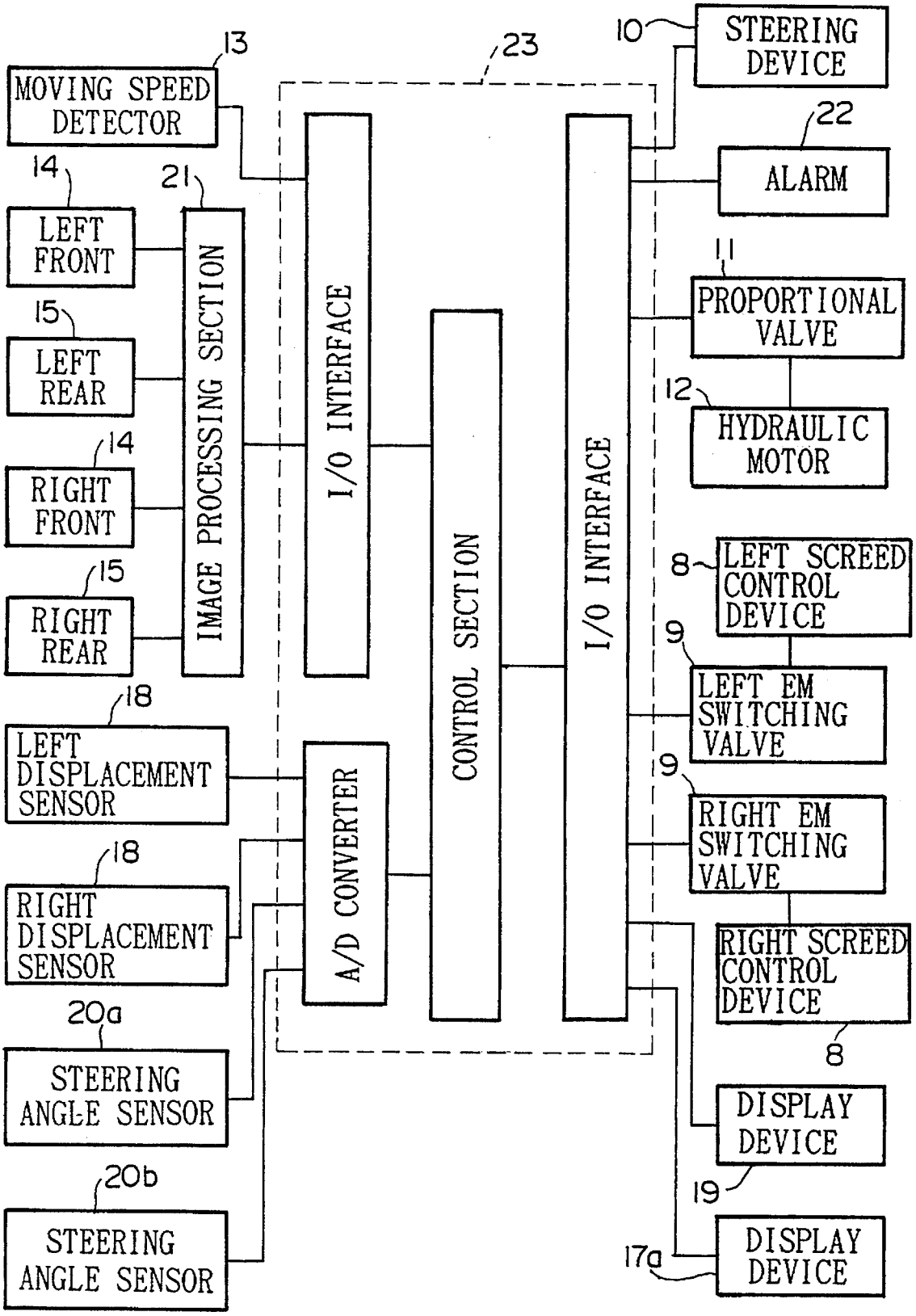
FIG. 8 is a block diagram to show the inter-relationship of the control devices and the detection devices.

The travel direction of the finisher can be altered by monitoring the steering angle $\alpha$ and $\beta$ (refer to FIG. 2) from the vehicle member 2 in accordance with the output signals from a pair of steering angle sensors **20*a*, 20*b* shown in FIG. 8, which monitor the rotation angles of the pair of front wheels 2*a* which rotate about the king pins 2*c***.

When the position of the screed 6 does not coincide with the reference line A, adjustments can be made by adjusting the screed controller 8 in accordance with the signals from a displacement sensor 18 (refer to FIG. 5) made of such devices, as linear potentiometers operating in conjunction with an encoder, provided on the screed 6. The displacement of the screed, indicating the extension or retraction of the screed 6, is displayed on a screen on a display device 19 (refer to FIG. 8). The display devices **17*a*, 19 are disposed in a convenient location in the vicinity of the operator seat 7**.

The detection devices 14, 15 are electrically connected to an image processing section 21. The image processing section 21, the moving speed detector 13, the displacement sensors 18, the EM-switching valves 9, the proportional valves 11, the display devices **17*a*, 19, the steering device 10, the steering angle sensors 20*a*, 20*b* and an alarm device 22 are all connected electrically to the master controller 23**.

The master controller 23 comprising various microcomputers performs the following functions.

(a) It controls the movement of the vehicle member 2 to move at a suitable speed by controlling the operation of the hydraulic motor 12 through the proportional valve 11.

(b) It controls the screed controller 8 through the EM-switching valve 9 to extend or retract the screed 6 to a suitable position.

(c) It judges whether the road width of the road D is becoming wider or narrower from the output signals from the detection devices 14, 15.

(d) It selects the rearward detection device 15 when the road width is becoming wider, and tracer control of the screed 6 in accordance with the output signals from the rearward detection device 15.

(e) It selects the forward detection device 14 when the road width is becoming narrower, and tracer control of the screed 6 in accordance with the output signals from the rearward detection device 14.

(f) It selects the rearward detection device 15 when the road width is unchanging, and tracer control of the screed 6 in accordance with the output signals from the rearward detection device 15.

(g) It lowers the speed of the vehicle member 2 when the screed 6 cannot keep up with the changes in the road width, and it stops the vehicle member 2 when the slowest vehicle speed does not permit the screed 6 to accommodate the changes in the road width.

(h) It performs the computations in the following equations (1), (2) and (3).

$$R=L/(\sin\beta)+d=\{K^2+(2KL/\tan\alpha)+(L/\tan\alpha)^2\}^{1/2}+d \quad (1)$$

$$r=[\{(R-d)\cos\beta-(m+K/2)\}^2+e^2]^{1/2} \quad (2)$$

$$i=r-\{(R-d)\cos\beta-(m+K/2)\} \quad (3)$$

where R: Turning radius of the outer front wheel 2*a* (right in FIG. 2)

L: Distance between front wheel 2*a* and the rear wheel 2*b*

K: Distance between axis of king pins 2*c* d: Distance between king pins 2*c* and the center of wheel to ground contact α: Inner wheel steering angle β: Outer wheel steering angle r: Radius of rotation of detection device 14 m: Distance between the longitudinal center line of vehicle member 2 and the detection device 14 e: Distance between the longitudinal center line of rear wheel axis and the detection device 14 i: Amount of deflection of detection device 14 by steering

The deflection i is determined in accordance with the Ackermann-Jantaud rotation theory which states that when a vehicle 2 makes a turn, the vehicle 2 turns about a point of intersection O of the line of extension of the axial center line of the front wheel 2*a* with the line of extension of the axis of the rear wheel 2*b*.

(i) Further, the master controller 23 makes the computations in the following equations (4) and (5).

It makes computations in the following equations.

$$\theta=\tan^{-1}(m1-m0)/vt \quad (4)$$

$$h=S-m\cdot\sin(90°-\theta)-L\cdot\cos(90°-\theta)-d \quad (5)$$

where: θ: Deviation angle of the center line of the vehicle member 2 with respect to the reference line A V: Moving speed of vehicle member 2 t: Time m0: Initial position of screed 6

M1: Position of screed 6 after time t

S: Distance between the reference line A and the limiting line for the front wheels 2*a* h: Spare distance of the outer front wheel 2*a* in reference to the distance S (j) Based on the computation results from the equations (1) to (5), it numerically controls the steering device 10 by inputting the parameters, for example, such as the change in the displacement Δm (=m1−m0) of the screed 6 and the deviation angle θ, and outputting steering angle β such that the amount of change in the displacement of the screed 6, Δm=0 and the deflection angle θ=0.

A control mode can be a left side mode in which the reference line A is on the left, or a right side mode in which the reference line A is on the right of the vehicle member 2; as well as a center mode, in which the amount of extension or retraction of the screed 6 is the same on the right and the left.

Next, the operation of the automatic control device when the vehicle member travels so as perform paving, for the asphalt finisher of the present invention will be explained in the following.

Figure 9:
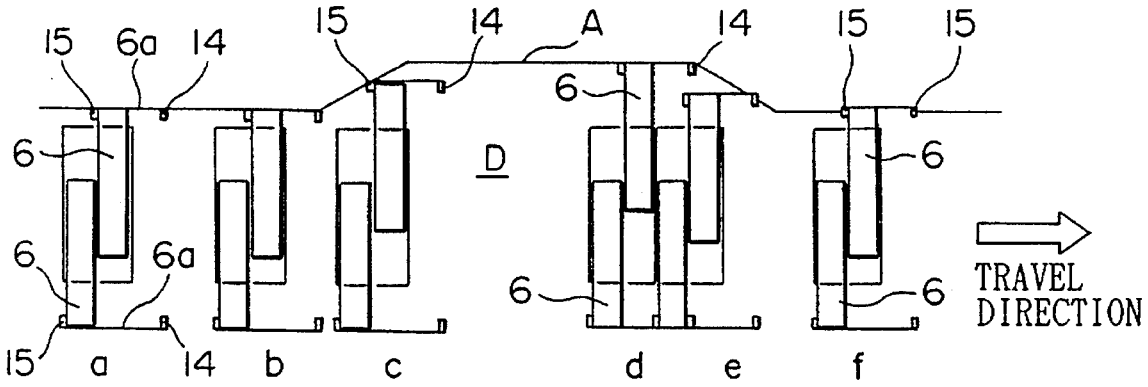
FIG. 9 is a schematic illustration to explain the control operation for extension or retraction of the screed.

FIG. 9 shows a basic example of automatic control of the displacement of only the screed 6. The case shown in position (a) is one of no change in the road width of the road D. The display screen on the controller 23 shows an output image from the forward and rearward detection devices 14, 15 which is the same as that shown in FIG. 7. From this image, the controller 23 judges the road dimension to be unchanging, and selects the rearward detection device 15 to perform the tracer control. In this case, since the road width is not changing, the screed 6 do not need to be moved, and the existing positions of the screed 6 is maintained.

Suppose the finisher 1 reaches a position (b) which is the initiation region of road widening, the forward detection device 14 detects that the reference line A has moved outward, but since the control is being undertaken by the selected rearward detection device 15, the screed does not change positions, and proceed as they are. When the rearward detection device 15 reaches the initial point of widening of the road, this detection device 15 too detects that the reference line A is outside its boundary. At this time, the controller 23 generates a command signal to the EM-switching valve 9 to operate the screed controller 8 so as to follow the reference line A as depicted in position (c).

A while later, the change in the road width ceases, and the screed 6 is maintained in the extended position. The control methodology is essentially the same as in position (a). As paving operation proceeds to position (d), the forward detection device 14 detects that the reference line A has moved inward, and the controller understands that the road width is becoming narrow, and this time, selects the forward detection device 14. The result is that the tracer control is now switched from the rearward detection device 15 to the forward detection device 14. The controller 23 now issues a command signal to the EM-switching valve 9 to operate the screed 6 to operate the screed controller 8 in the opposite direction to the previous case. This is depicted in the position (e) in which the screed 6 is now in a retracted position.

When the narrowing of the road width ceases and the road width assumes a stable dimension, the controller 23 again selects the rearward detection device 15 and the control methodology becomes the same as in position (a). This is depicted in position (f).

There are cases when the speed of the vehicle member 2 is too fast for the rate of change of the reference line A. Such case are of two types. One occurs while the control operation is being carried out by the rearward detection device 15, and the reference line A continues to follow an outward direction in spite of the fact that the screed 6 is being extended. The other case occurs when the control operation is being carried out the the forward detection device 14 and the reference line A continues to follow an inward direction in spite of the fact that the screed 6 is being retracted. In such cases, the controller 23 generates a command signal to the proportional valve 11 to decrease the speed of the vehicle member 2 by lowering the speed of rotation of the hydraulic motor 12. If this step is still insufficient so that the displacement of the screed 6 cannot match the change in the road width, the vehicle member 2 is stopped temporarily, and restarted after making a complete readjustment of the control parameters.

When it is necessary to make emergency adjustment, such as changes in the speed of the vehicle member 2 and stoppage, the controller 23 may activate the alarm device 22. The operator is able to assess the paving conditions from the displays in the display devices 17*a*, 19 and from such warning signal sounded by the alarm device 22.

Figure 2:
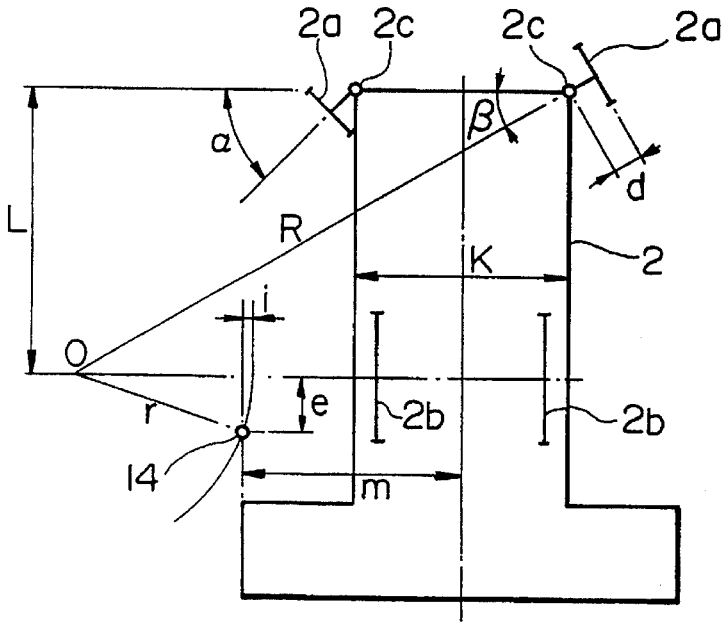
FIG. 2 shows the relationship between the steering angle and the deflection angle of the vehicle member.
Figure 3:
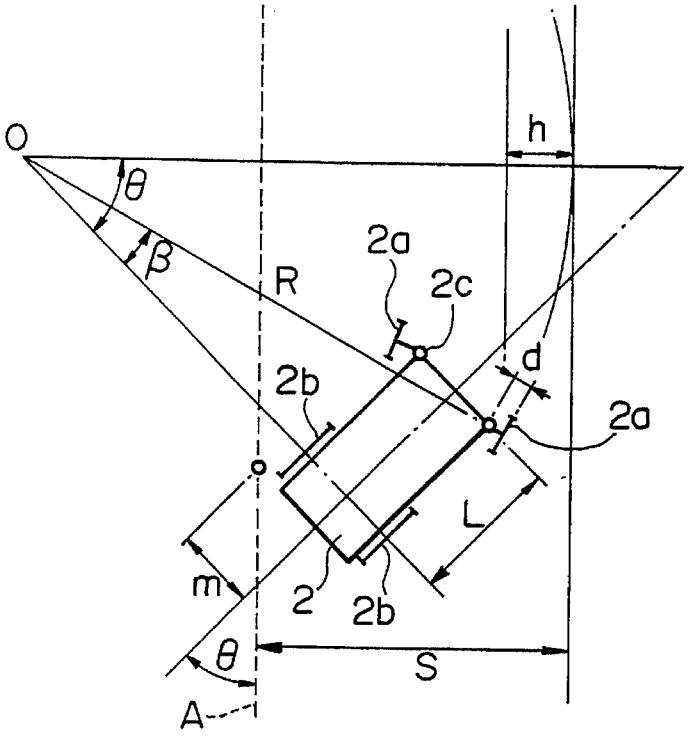
FIG. 3 shows the relationship between the steering angle and the deviation angle.
Figure 4:
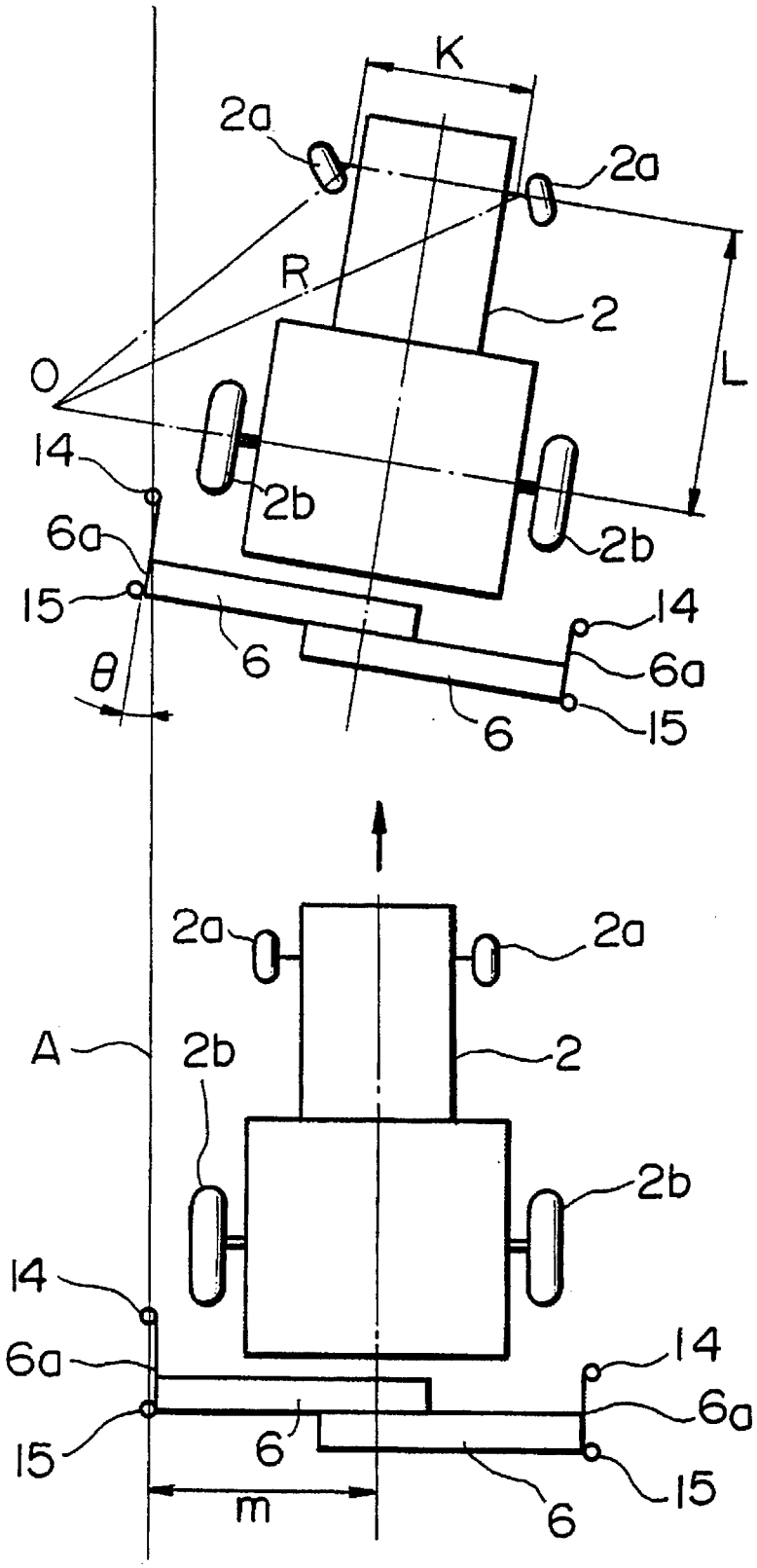
FIG. 4 is an illustration to explain the steering correction operation.
Figure 5:
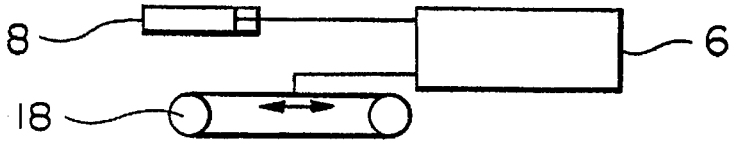
FIG. 5 is a schematic illustration of the relationship between the screed and the screed controller.
Figure 6:
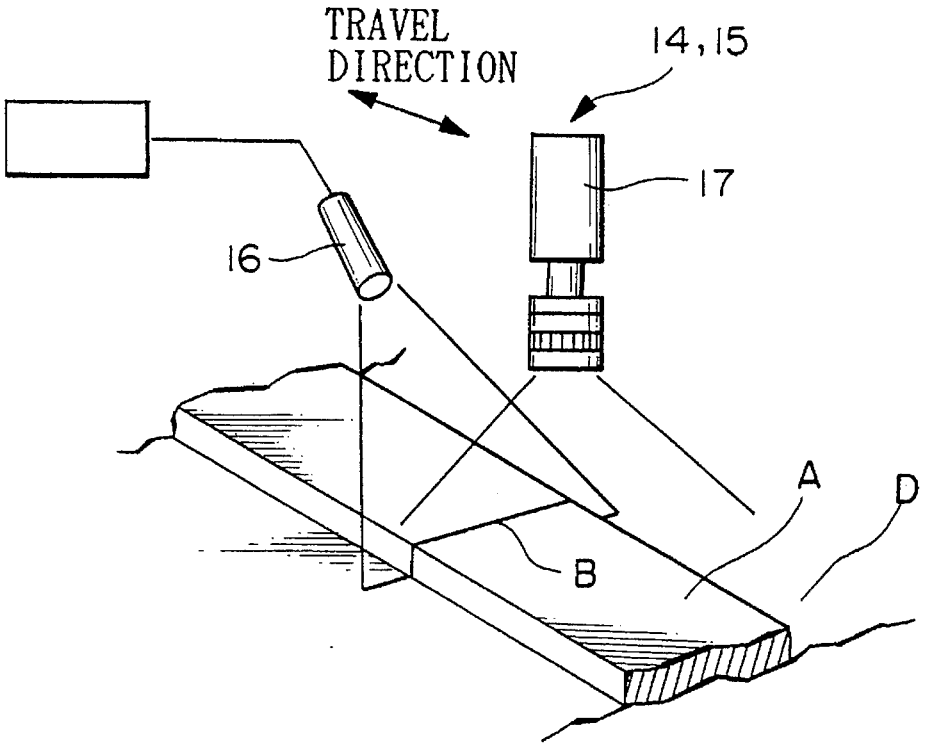
FIG. 6 is an example of the arrangement of the control device of the present invention.

FIGS. 2 to 4 illustrate some examples of the steering control. Severe and rapid directional change is not desirable from the standpoint of making safe paving as well as from the safety of the paving operation. Therefore, the amount of steering is limited to the following three conditions.

(i) The steering angle is limited so that the overhang of the screed 6 over the pavement is within the upper and the lower limits (±20 mm) by limiting the value of Δm (the displacement of the screed 6 with respect to the reference line A) by the upper and lower limit of extension of the screed controller 8.

(ii) The radius of rotation and the steering angle are limited by defining the permissible outer boundary for the front wheels 2a so that the overshoot distance is within the upper and the lower limits (±20 mm).

(iii) A warning is issued to the operator when the computed values exceed the range of permissible input parameters as defined above.

The control device can be placed in automatic mode, and in this case, the operator selects the control mode (left side mode, right side mode or center mode). The screed controller 8 is operated on the reference line A to set a reference value, and the value of the stoke of the cylinder of the screed 6 is inputted into the controller 23. The point of intersection O is defined by replacing the distance to the reference line A with the value of the stroke. The operator also selects the automatic mode from the choices between automatic control or manual control operational mode. Also the detection mode is set to be two detection devices 14, 15 (a total of four including the left and right side devices).

Figure 10:
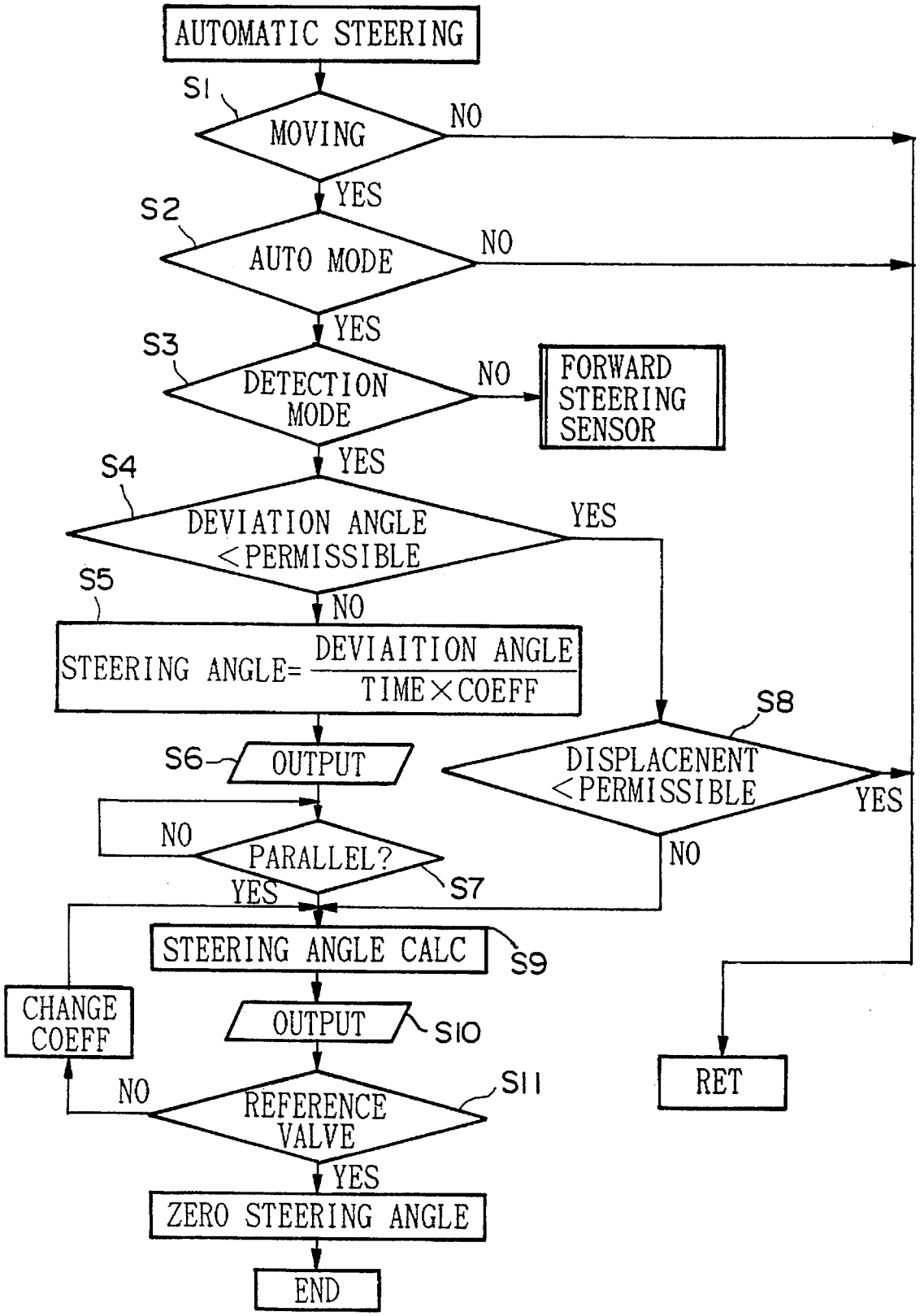
FIG. 10 is a flow chart for the directional control operation.

FIG. 10 shows an example of the steps involved in the automatic operational mode (adaptable control) by the controller 23 (which is referred to by "it" in the following description). First, in step S1, it determines whether the finisher 1 is moving or not moving. If the finisher 1 is moving, the decision is yes, and it proceeds to step S2. In step S2, it determines whether the finisher 1 is in automatic or manual mode. If the finisher 1 is in automatic mode (Yes), then it proceeds to step S3, and it examines if there are two devices for the detection device 14, 15. If yes, it proceeds to step S4, and it examines whether the deviation angle θ is less than the allowable value. If the deviation angle θ is more than the allowable value (referred by No), it proceeds to step S5. In step S5, it computes the steering angles α, β for the front wheels 2a, and inputs the value in the steering device 10 in step S6. Proceeding to step S7, it operates the steering device 10 until the longitudinal center line of the vehicle member 2 (or the line joining the detection devices 14, 15) becomes parallel with the reference line A. When the result in step S7 becomes Yes, it proceeds to step S9.

Returning to step S4, if the result is Yes, it proceeds to step S8, and it examines whether the displacement value Δm is less than the allowable value, and if the result is No, it proceeds to step S9. In step S9, it computes the steering angle to make the line joining the detection devices 14, 15 and the reference line A parallel, and outputs this value to the screed controller 8 in step S10, and it proceeds to step S11. In step S11, it operates the screed controller 8 until the computed value is attained, and when the result becomes Yes, then the steering angle becomes zero, and the operation is completed.

When paving is to be performed by two finishers 1, the edge line of the leading finisher 1 is usually used as the reference line A by the trailing finisher 1. In this case, the inner rearward detection device 15 of the trailing finisher 1 cannot function because of the loss of the reference line A which has been eliminated by the paving made by the trailing finisher 1. The trailing finisher 1 is then left only with the forward detection device 14. In this case, in step S3, the detection mode is set to be the detection mode using only the one detection device 14. This mode in step S3 results in No, and it leads to another separate mode of operation (forward sensor steering).

The automatic controls over the displacement action in the screed 6 and over the front wheels 2a are generally performed together. Therefore, in position (c) in FIG. 9 which is the case of widening road width of the road D, the steering is to the right, and in the case of position (e) in which the road width of the road D is becoming narrow, the steering is to the left. In FIG. 9, left side mode is chosen, and in this case, the reference line A on the right side (not shown in FIG. 9) does not contribute to the steering operation, and is used for controlling the extension or retraction operation of the right side screed 6. The operation according to the center mode is performed by setting an imaginary reference line so as to make the left and right displacement values always equal to each other.

Figure 11:
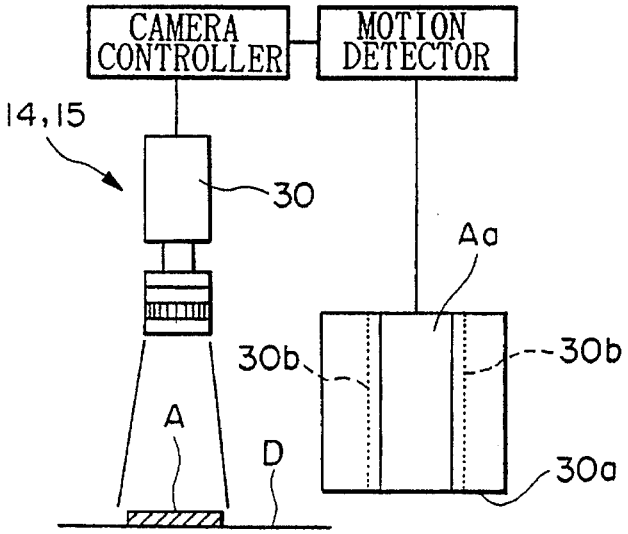
FIG. 11 is a schematic drawing showing the arrangement for another detection device.

FIG. 11 shows another embodiment of the system of detection devices 14, 15 of the present invention. In this system, there is provided a series of (latent) check points 30b on the screen of the display device 30a. The positions of the check points 30b can be specified at will anywhere on the screen. The system is designed to alert the operator by generating a signal when the reference line A coincides with one of the check points 30b. After selecting the position for the check points 30b on the screen, there is no need to keep displaying the check points 30b on the screen of the display device 30a, therefore, there is no disturbance to the viewing of the usual display image. To operate this system, the reference line A is prerecorded by the CCD camera 30, and the image Aa of the reference line A is displayed on the screen of the display device 30a. The controller 23 examines whether the reference line A is in the correct position with respect to the specified check point 30b, and if it is in the correct position, the controller 23 allows the processing to be carried out.

Figure 12:
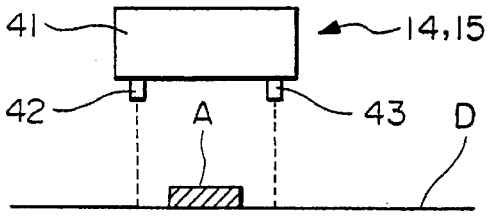
FIG. 12 is a schematic drawing showing the arrangement for yet another detection device.

FIG. 12 shows yet another embodiment of the system of detection devices 14, 15. In this system, the detection devices 14, 15 comprise a left and a right pieces of detection sensors 42, 43 such as ultrasonic transducers or laser photodetectors disposed on the block 41 attached to the end plate. The detection sensors 42, 43 measures the distance R0 from the end plate to the road surface of the road D, and inputs this reference data into the controller 23. During the operation of this system, if the current measured distance R becomes lower than the reference distance R0, the system decides that the finisher 1 has moved onto the raised reference objects defining the reference line A, and issues commands to move the screed 6 in the opposite direction.

The other details of construction of the system shown in FIGS. 11, 12 are the same as those for the first embodiment. The reference objects, other than edging stones, which can be used to define the reference line A are: edges of ditches, forming frames, paved road as well as colored lines drawn on the road. The latter objects which do not posses a height cannot be detected with the detection devices, 14, 15 shown in FIG. 6, however, they can be detected with the detection devices 14, 15 shown in FIGS. 6 and 11. For colored lines, there is no need to use laser light, and it would be possible to use simple black and white displays to provide binary information displays to check the accuracy of alignment of the finisher with respect to the white reference line A.

It should be noted also that the accuracy of alignment within the framework of road construction should be defined with a degree of latitude, and such operations can be efficiently undertaken by a "fuzzy" control methodology.

What is claimed is:

1. A device for controlling the extension or retraction of a plurality of screeds in an asphalt finisher comprising:

a screed controller disposed on a vehicle member for extending and retracting said plurality of screeds to the left or to the right of said asphalt finisher so as to perform a levelling operation;

a detection device disposed on a side region of a screed for detecting the position of a reference line generated in relation to a roadside line;

a master controller for computing a deviation of the current travel direction of said screed from said reference line in accordance with the output data from said detection device when said vehicle member travels so as to perform paving, and adjusts the extension or retraction of said screed controller in accordance with a computed deviation so as to force said screed to move along an image of the reference line.

2. A device as claimed in claim 1, wherein said detection device is provided as a pair of detection devices wherein each device is disposed on a line parallel to the longitudinal center line of said vehicle member.

3. A device as claimed in claim 1, wherein said detection device comprises: a semiconductor laser generator, a recording device for recording the image generated by irradiating a series of objects along a roadside with laser light.

4. A device as claimed in claim 1, wherein said master controller decreases the travelling speed of said vehicle member when the extension or retraction operation of said screed is unable to compensate for the computed deviation.

5. A device as claimed in claim 1, wherein said master controller stops the movement of said vehicle member when a drop in the travelling speed is insufficient to compensate for the deviation.

6. A device as claimed in claim 3, wherein said screed controller is provided with a display device for displaying said image generated.

7. A device as claimed in claim 6, wherein said display device is able to display latent check points for defining a deviation of the direction of travel of said vehicle member from said reference line.

8. A device as claimed in claim 1, wherein said detection device comprises a pair of height detectors for measuring the distance to the road surface disposed separately on a horizontal plane at right angles to the longitudinal center line of said vehicle member.

9. An automatic controlling device for an asphalt finisher comprising:

a steering device for controlling the direction of travel of said asphalt finisher having a plurality of screeds for performing a levelling operation;

a screed controller for controlling the extension or retraction of said plurality of screeds to the left and to the right of said asphalt finisher;

a detection device disposed on a side region of a screed for detecting the position of a reference line generated in relation to a roadside line;

a master controller for computing a deviation of the current travel direction of said screed from said reference line in accordance with the output data from said detection device when said vehicle member travels so as to perform paving, and adjusts the extension or retraction of said screed controller in accordance with a computed deviation so as to force said screed to move along said image of the reference line.

10. An automatic controlling device as claimed in claim 9, wherein said detection device is provided as a pair of detection devices wherein each device is disposed on a line parallel to the longitudinal center line of said vehicle member.

11. An automatic controlling device as claimed in claim 9, wherein said detection device comprises: a semiconductor laser generator, a recording device for recording an image generated by irradiating a series of objects along a roadside with laser light.

12. An automatic controlling device as claimed in claim 9, wherein said master controller decreases the travelling speed of said vehicle member when the extension or retraction operation of said screed is unable to compensate for the computed deviation.

13. An automatic controlling device as claimed in claim 9, wherein said master controller stoops the movement of said vehicle member when a drop in the travelling speed is insufficient to compensate for the deviation.

14. An automatic controlling device as claimed in claim 9, wherein said master controller computes a deviation angle between said reference line and a longitudinal center line of said vehicle member, and adjusts said steering device until said longitudinal center line of said vehicle member becomes parallel with said reference line.

15. An automatic controlling device as claimed in claim 11, wherein said screed controller is provided with a display device for displaying said image generated.

16. An automatic controlling device as claimed in claim 15, wherein said display device is able to display latent check points for defining a deviation of the direction of travel of said vehicle member from said reference line.

17. An automatic controlling device as claimed in claim 9, wherein said detection device comprises a pair of height detectors for measuring the distance to the road surface disposed separately on a horizontal plane at right angles to the longitudinal center line of said vehicle member.

* * * * *